US005186906A

United States Patent [19]

Kawakami et al.

[11] Patent Number: 5,186,906

[45] Date of Patent: Feb. 16, 1993

[54] APPARATUS FOR MOUNTING A HONEYCOMB STRUCTURE IMPREGNATED WITH A CATALYST IN A FLOW TUBE

[75] Inventors: Takashi Kawakami, Yokohama; Susumu Handa, Tokyo, both of Japan

[73] Assignees: Kabushiki Kaisha Toshiba, Kawasaki; The Tokyo Electric Power Co., Inc., Tokyo, both of Japan

[21] Appl. No.: 459,311

[22] Filed: Dec. 29, 1989

[30] Foreign Application Priority Data

Feb. 10, 1989 [JP] Japan ..... 1-29759

[51] Int. Cl.[5] ..... B01D 53/34; F01N 3/10; F01N 3/24

[52] U.S. Cl. ..... 422/180; 422/179; 422/221; 422/222

[58] Field of Search ..... 422/179, 180, 221, 222

[56] References Cited

U.S. PATENT DOCUMENTS

| | | | |
|---|---|---|---|
| 4,115,071 | 9/1978 | Masuda et al. | 422/180 X |
| 4,142,864 | 3/1979 | Rosynsky et al. | 422/180 X |
| 4,161,509 | 7/1979 | Nowak | 422/179 |
| 4,328,187 | 5/1982 | Musall et al. | 422/179 |
| 4,344,922 | 8/1982 | Santiago et al. | 422/180 |
| 4,350,664 | 9/1982 | Gaysert | 422/180 |
| 4,360,957 | 11/1982 | Eng | 422/180 |
| 4,362,700 | 12/1982 | Hayashi et al. | 422/179 |
| 4,413,470 | 11/1983 | Scheihing et al. | 422/180 |
| 4,581,206 | 4/1986 | Otani et al. | 422/179 |
| 4,600,562 | 7/1986 | Virk et al. | 422/180 |

OTHER PUBLICATIONS

1 Patent Practice 2–19 (PR1 1989).

SAE Technical Paper Series 850130, "Long-Term Durability of Ceramic Honeycombs for Automotive Emissions Control", S. T. Gulati, 2/85, FIG. 13, pp. 7–8).

*Primary Examiner*—Robert J. Warden

*Assistant Examiner*—Stephanie Blythe

*Attorney, Agent, or Firm*—Oblon, Spivak, McClelland, Maier & Neustadt

[57] ABSTRACT

A catalytic combustion apparatus for gas turbine or an exhaust gas purifier apparatus comprises a honeycomb structure disposed in a flow tube. A ring-shaped fringe region of the lower-course end face of the honeycomb structure abuts against a ring-shaped second supporting member. The second supporting member has a plurality of passages which allow a fluid to flow out downstream from the fringe region. In this arrangement, the fluid from the fringe region is caused to flow downstream through these passages. Accordingly, tensile thermal stress is reduced, so that the honeycomb structure is prevented from being damaged thereby. Since the honeycomb structure is supported by the second supporting member in planar contact therewith, moreover, stress is prevented from being concentrated on part of the structure. Thus, the honeycomb structure can be securely supported without being damaged by any stress.

5 Claims, 3 Drawing Sheets

APPARATUS FOR MOUNTING A HONEYCOMB STRUCTURE IMPREGNATED WITH A CATALYST IN A FLOW TUBE

BACKGROUND OF THE INVENTION

1. Field of the Invention

The present invention relates to a catalytic combustion apparatus for gas turbine or an exhaust gas purifier apparatus having a honeycomb structure impregnated with a catalyst, and more particularly, to an apparatus for mounting the honeycomb structure in a tube of the combustion or purifier apparatus through which a high-speed high-temperature fluid flows.

2. Description of the Related Art

In a catalytic combustion apparatus for gas turbine, a honeycomb structure impregnated with a catalyst is mounted in a tube through which a high-speed high-temperature fluid, e.g., a combustion gas, flows downstream. In this arrangement, the combustion gas is subjected to a catalytic reaction, and its temperature is kept below a predetermined level (1,300° C.), so that production of $NO_x$ is restrained. For the same purpose, an exhaust gas purifier apparatus is also provided with a honeycomb structure.

The honeycomb structure has upper- and lower-course end faces extending at right angles to the axial direction in which the combustion gas flows. The structure also includes a number of cells which allow the combustion gas to flow from the upper-course end face to the lower-course end face, and cause the gas to come into satisfactory contact with the catalyst. The honeycomb structure is formed of a ceramic material, e.g., cordierite, in order to be able to be fully impregnated with the catalyst. This ceramic material, however, is very brittle.

The honeycomb structure is surrounded and radially supported by a cylindrical supporting member which has a shock absorbing effect. Thus, even though the honeycomb structure and the tube are expanded to different degrees by the combustion gas, due to the difference in coefficient of linear expansion between them, the shock absorbing supporting member absorbs the force from the tube to press the structure. In this manner, the brittle honeycomb structure is prevented from being damaged.

The honeycomb structure is also supported in the axial direction of the tube. Thus, it is prevented from being dislocated in the axial direction by means of the high pressure of the combustion gas. More specifically, a ring-shaped fringe region of the lower-course end face of the honeycomb structure abuts against the ring-shaped supporting member. In this arrangement, the honeycomb structure is supported in the axial direction, and the combustion gas is allowed to flow out downstream from a central region of the lower-course end face of the structure.

The ring-shaped fringe region, however, is covered by the ring-shaped supporting member. Accordingly, the combustion gas cannot flow out downstream from the fringe region, and catalytic reaction can hardly take place in the fringe region. As a result, the temperature of the fringe region is lower than that of the central region. In other words, a temperature gradient is created in the radial direction of the honeycomb structure. Thus, tensile thermal stress may possibly be produced between the fringe region and the central region, and damage the structure.

In the exhaust gas purifier apparatus, a flow tube for an exhaust gas has a taper portion whose diameter becomes smaller with distance from its upper-course end. The lower-course edge of the honeycomb structure abuts against the taper portion, thereby axially supporting the structure. In other words, the lower-course edge of the honeycomb structure is supported by the tape portion in linear contact therewith. Therefore, catalytic reaction can take place even in the fringe region, and no thermal stress can be produced. The pressure of the exhaust gas in the purifier apparatus is lower than that of the combustion gas in the catalytic combustion apparatus. Thus, in the exhaust gas purifier apparatus, the honeycomb structure cannot be dislocated downstream even though it is supported by the taper portion only in linear contact therewith.

If the supporting method using the taper portion is applied to the catalytic combustion apparatus, however, stress may possibly be concentrated on the lower-course edge of the honeycomb structure, thereby damaging the structure, since the pressure of the combustion gas is relatively high.

SUMMARY OF THE INVENTION

The object of the present invention is to provide a mounting apparatus which can securely support a honeycomb structure, and prevent production of thermal stress in the structure and concentration of stress on part of the structure, thereby preventing the honeycomb structure from being damaged by stress.

According to the present invention, there is provided a mounting apparatus for mounting a honeycomb structure impregnated with a catalyst in a tube through which a high-speed high-temperature fluid flows downstream, the tube having an axial direction in which the fluid flows and a radial direction perpendicular to the axial direction. The honeycomb structure has upper- and lower-course end faces extending at right angles to the axial direction and a plurality of cells which allow the fluid to flow from the upper-course end face to the lower-course end face. The mounting apparatus includes a first supporting member fixed in the tube and surrounding the honeycomb structure, thereby supporting the honeycomb structure in the radial direction, and a ring-shaped second supporting member fixed in the tube and contacting with a ring-shaped fringe region of the lower-course end face of the honeycomb structure, thereby supporting the honeycomb structure in the axial direction. The second supporting member has a plurality of passages which allow the fluid to flow out downstream from the fringe region.

According to the invention, the honeycomb structure is supported in the axial direction by the ring-shaped second supporting member, and in the radial direction by the first supporting member. Thus, the honeycomb structure is securely supported by the two supporting members.

The fluid from the gas is caused to flow out downstream from the ring-shaped fringe region can be caused to flow downstream through the passages of the ring-shaped second supporting member. Also in this fringe region, therefore, catalytic reaction can take place without restraint. Accordingly, a temperature difference can hardly be produced between the fringe region and a central region of the honeycomb structure. Namely, the honeycomb structure can hardly be subjected to any temperature gradient in the radial direction. In consequence, tensile thermal stress in the radial direction is reduced, so that the honeycomb structure is prevented from being damaged thereby.

Further, the honeycomb structure is axially supported by the ring-shaped second supporting member in planar contact therewith. Thus, stress is prevented from being concentrated on part of the honeycomb structure, so that the structure cannot be damaged by stress concentration.

Thus, according to the present invention, the honeycomb structure can be securely supported without being damaged by any stress.

DETAILED DESCRIPTION OF THE PREFERRED EMBODIMENTS

Figure 1:
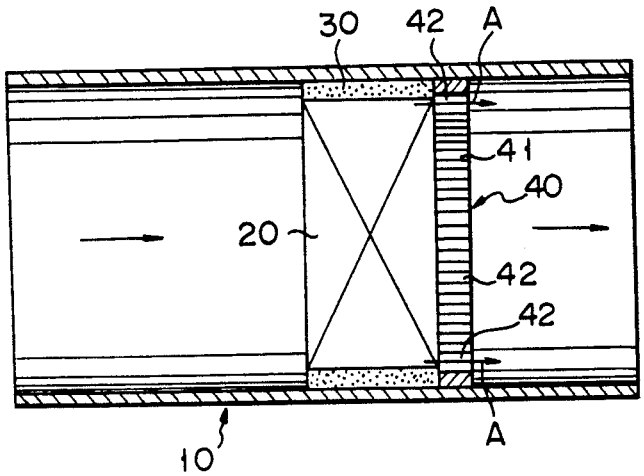
FIG. 1 is a sectional view of a flow tube of a catalytic combustion apparatus for gas turbine or an exhaust gas purifier apparatus according to a first embodiment of the present invention, as taken along the axis thereof.

Referring now to FIG. 1, there is shown flow tube 10 of a catalytic combustion apparatus for generating gas turbine or an exhaust gas purifier apparatus according to a first embodiment of the present invention. A high-speed high-temperature fluid is caused to flow downstream (from left to right in FIG. 1) in tube 10. In the catalytic combustion apparatus, a combustion gas is caused to flow downstream in tube 10, and is then supplied through the outlet of the tube to a generating gas turbine (not shown) which is connected to the tube outlet. In the exhaust gas purifier apparatus, an exhaust gas is caused to flow downstream in tube 10. Tube 10 has an axial direction, in which the fluid flows, and a radial direction perpendicular to the axial direction.

Figure 2:
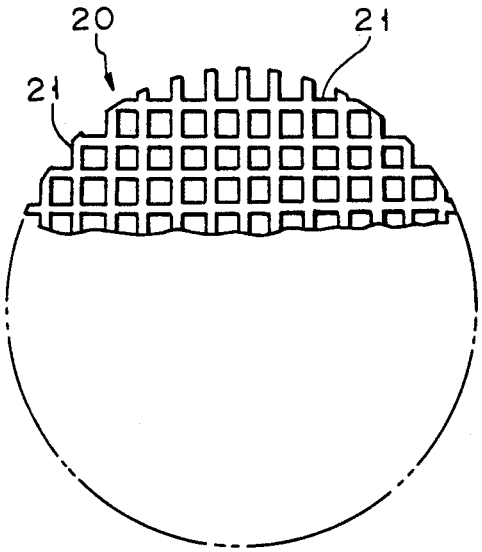
FIG. 2 is a schematic view of a honeycomb structure in the flow tube, as taken from the upper-course side.

Honeycomb structure 20 shown in FIG. 2 is disposed in tube 10. Structure 20 has upper- and lower-course end faces which extend at right angles to the axial direction. It also includes a number of cells 21 which allow the combustion gas to flow from the upper-course end face to the lower-course end face, and cause the gas to come into satisfactory contact with a catalyst. The honeycomb structure is formed of a ceramic material, e.g., cordierite, in order to be able to be fully impregnated with the catalyst. Cells 21 are arranged at a density of 100 to 200 to one inch square. The pitch of cells 21 ranges from 1.5 to 1.8 mm.

Honeycomb structure 20 is surrounded by cylindrical first supporting member 30 fixed to the inner wall of tube 10, so that it is supported in the radial direction. Supporting member 30 is formed of a material which has a shock absorbing effect. Thus, even though structure 20 and tube 10 are expanded to different degrees by the combustion gas, due to the difference in coefficient of linear expansion between them, supporting member 30 absorbs the force from tube 10 to press structure 20. In this manner, the honeycomb structure is prevented from being damaged.

Further, honeycomb structure 20 is supported in the axial direction by ring-shaped second supporting member 40 fixed to the inner wall of tube 10. Thus, a ring-shaped fringe region of the lower-course end face of structure 20 abuts against the ring-shaped upper-course end face of supporting member 40. The inside diameter of second supporting member 40 is shorter than the outside diameter of honeycomb structure 20 by a predetermined margin. Thus, structure 20 is prevented from being dislocated downstream, and the combustion gas is allowed to flow out downstream from a central region of the lower-course end face of structure 20.

Figure 3:
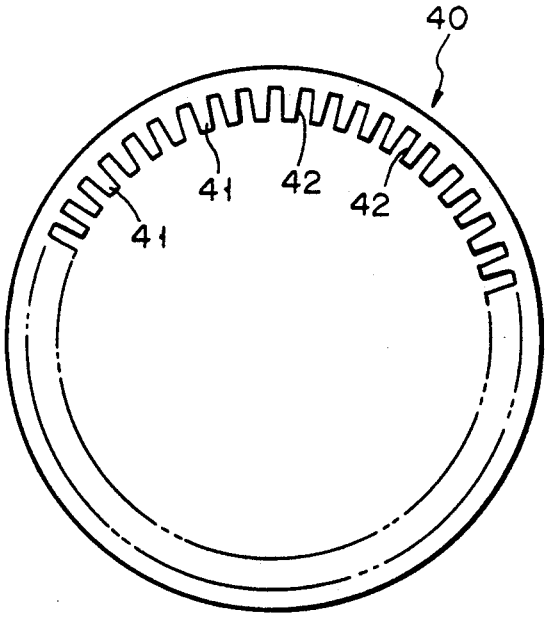
FIG. 3 is a schematic view of a ring-shaped second supporting member in the flow tube, as taken from the upper-course side.

In the present invention, moreover, second supporting member 40 has a number of comb teeth 41 formed on the inside thereof with respect to the radial direction, so as to face the ring-shaped fringe region of the lower-course end face of honeycomb structure 20, as shown in FIG. 3. Each tooth 41 extends in the axial direction of the second supporting member so as to cover the overall length thereof. Defined between teeth 41 are passages 42 which allow the combustion gas to flow out downstream from the ring-shaped fringe region. The pitch of passages 42 is 1.0 mm, which is shorter than the pitch of cells 21. Passages 42 and cells 21 may be arranged at substantially equal pitches.

The following is a description of the operation of the apparatus.

When the combustion gas or exhaust gas enters the cells of honeycomb structure 20, it undergoes a catalytic reaction. Thereafter, most of the gas is caused to flow downstream through the central region of the lower-course end face of structure 20.

In the conventional case, the gas is not allowed to flow out downstream from the ring-shaped fringe region of the lower-course end face of honeycomb structure 20. According to the present invention, however, ring-shaped second supporting member 40 has a number of passages 42 which face the fringe region. In this arrangement, the gas is caused to flow out downstream from the ring-shaped fringe region through passages 42, as indicated by arrow A in FIG. 1. Also in this fringe region, therefore, catalytic reaction can take place without restraint. Accordingly, a temperature difference can hardly be produced between the fringe region and the central region of the honeycomb structure. Namely, the honeycomb structure can hardly be subjected to any temperature gradient in the radial direction. In consequence, tensile thermal stress in the radial direction is reduced, so that the honeycomb structure is prevented from being damaged thereby.

Thus, according to the present invention, honeycomb structure 20 is supported in the axial direction by ring-shaped second supporting member 40, and in the radial direction by first supporting member 30. In other words, the honeycomb structure is securely supported by the two supporting members.

As mentioned before, moreover, the tensile thermal stress in the radial direction is reduced, so that honeycomb structure 20 is prevented from being damaged by the tensile stress.

Further, honeycomb structure 20 is axially supported by ring-shaped second supporting member 40 in planar contact therewith. Thus, stress is prevented from being concentrated on part of structure 20, so that structure 20 cannot be damaged by stress concentration.

Thus, according to the present invention, the honeycomb structure can be securely supported without being damaged by any stress.

Figure 4A:
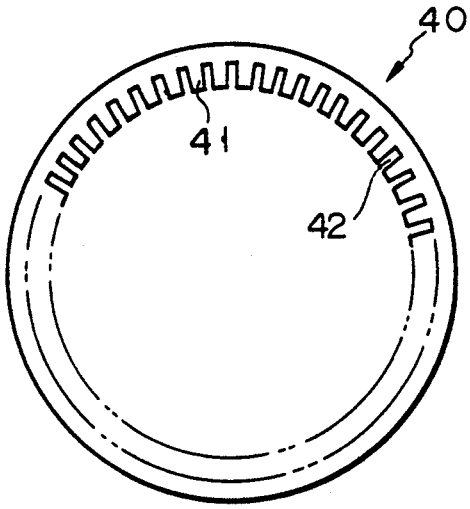
FIG. 4A is a schematic view of a second supporting member according to a modification of the first embodiment, as taken from the upper-course side.
Figure 4B:
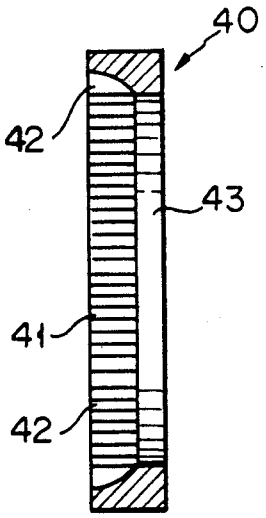
FIG. 4B is a sectional view of the second supporting member of FIG. 4A, as taken along the axis thereof.

FIGS. 4A and 4B show a modification of the second supporting member. In this case, each passage 42 extends in the axial direction of second supporting member 40 so as to cover half the length thereof, and hole 43 is formed on the lower-course side of passages 42. In this arrangement, the gas from the ring-shaped fringe region is caused to flow downstream through passages 42 and hole 43.

Figure 5A:
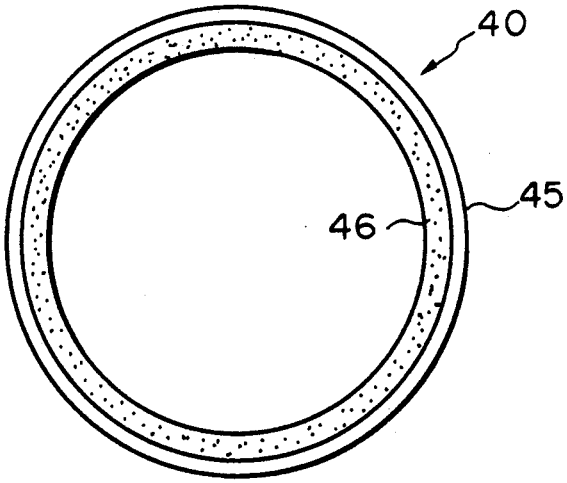
FIG. 5A is a schematic view of a second supporting member according to another modification of the first embodiment, as taken from the upper-course side.
Figure 5B:
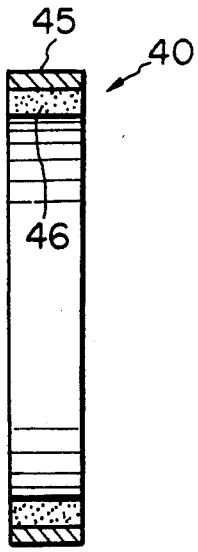
FIG. 5B is a sectional view of the second supporting member of FIG. 5A, as taken along the axis thereof.

FIGS. 5A and 5B show another modification of the second supporting member. In this case, second supporting member 40 includes outer ring member 45 fixed to the inner wall of tube 10 and inner ring member 4 fixed to the inner wall of member 45. Inner member 46 is formed of a porous structure having a number of pores which define passages 42. In this arrangement, the gas from the ring-shaped fringe region is caused to flow downstream through the pores of the porous structure.

Figure 6:
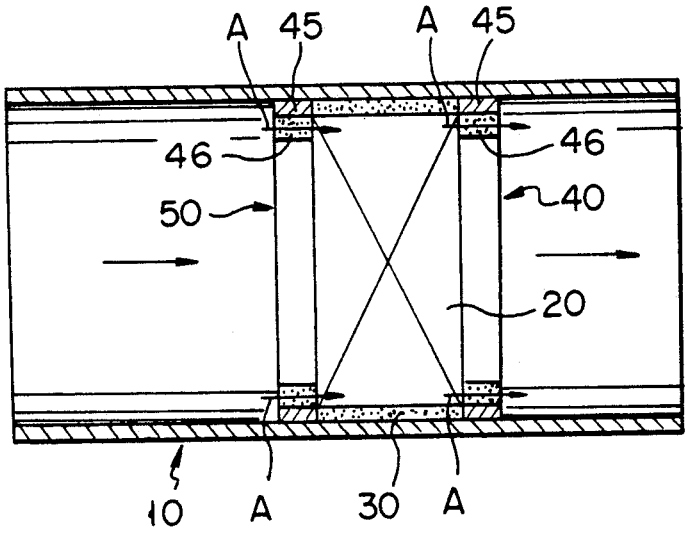
FIG. 6 is a sectional view of a flow tube of a catalytic combustion apparatus for gas turbine or an exhaust gas purifier apparatus according to a second embodiment of the present invention, as taken along the axis thereof.

FIG. 6 shows a second embodiment of the present invention. In this case, third supporting member 50 is disposed on the upper-course side of honeycomb structure 20. Thus, a second ring-shaped fringe region of the upper-course end face of structure 20 abuts against the lower-course end face of supporting member 50. Second and third supporting members 40 and 50, like the modification shown in FIG. 5, is composed of outer ring member 45 and porous inner ring member 46. In this arrangement, honeycomb structure 20 can be more securely supported by second and third members 40 and 50 without entailing production of any thermal stress therein.

It is to be understood that the present invention is not limited to the embodiments described above, and that various changes and modifications may be effected therein by one skilled in the art without departing from the scope or spirit of the invention.

What is claimed is:

1. An apparatus, comprising:

a tube through which a high-speed high-temperature fluid flows downstream, said tube having an axial direction in which the fluid flows and a radial direction perpendicular to the axial direction a honeycomb structure impregnated with a catalyst and having upper- and lower-course end faces extending at right angles to the axial direction and a plurality of cells which allow the fluid to flow from the upper-course end face to the lower-course end face;

a first supporting member fixed in the tube and surrounding the honeycomb structure, thereby supporting the honeycomb structure in a radial direction relative to the axial direction of the tube; and a ring-shaped second supporting member fixed in the tube, having a ring-shaped contact region contacting with a ring-shaped fringe region of the lower-course end face of the honeycomb structure, and having a central hole through which the fluid except for that of the ring-shaped fringe region of the honeycomb structure flows out downstream, said second supporting member having a number of comb teeth and passages between adjacent ones of the comb teeth in the ring-shaped contact region, the comb teeth having substantial width so as to support the honeycomb structure in the axial direction, the passages having a substantial width such that the fluid of the fringe region of the honeycomb structure can flow out downstream, a pitch of the passages being substantially equal to a pitch of the honeycomb structure.

2. The apparatus according to claim 1, wherein each said passage of the second supporting member extends in an axial direction of the second supporting member so as to cover an overall length thereof.

3. The apparatus according to claim 1, wherein each said passage of said second supporting member extends in an axial direction of the second supporting member so as to cover a middle length thereof.

4. The apparatus according to claim 1, wherein said second supporting member is formed of a porous structure having a number of pores defining the passages.

5. The apparatus according to claim 1, wherein the upper-course end face has a second ring-shaped fringe region defined thereon, and which further comprises a ring-shaped third supporting member fixed in the tube and contacting with the second fringe region of the honeycomb structure, thereby supporting the honeycomb structure in the axial direction, said third supporting member having a plurality of passages which allow the fluid to flow from the upper-course side into the second fringe region.

* * * * *